United States Patent [19]

Scott et al.

[11] 4,316,327

[45] Feb. 23, 1982

[54] CHAIN SAW

[75] Inventors: Lewis A. Scott, Lake Oswego; Duane M. Gibson, Milwaukie, both of Oreg.

[73] Assignee: Omark Industries, Inc., Portland, Oreg.

[21] Appl. No.: 15,111

[22] Filed: Feb. 26, 1979

[51] Int. Cl.[3] ..... B27B 17/00

[52] U.S. Cl. ..... 30/386

[58] Field of Search ..... 30/385, 386, 387, 381, 30/382, 383, 384

[56] References Cited

U.S. PATENT DOCUMENTS

| | | | |
|---|---|---|---|
| 830,860 | 9/1906 | Smith | 30/386 X |
| 853,350 | 5/1907 | Fullerton | 30/384 |
| 893,897 | 7/1908 | Bens | 30/385 |
| 2,774,395 | 12/1956 | Tweedie | 30/386 |
| 3,593,804 | 7/1971 | Snider | 30/381 X |

FOREIGN PATENT DOCUMENTS

| | | | |
|---|---|---|---|
| 607857 | 11/1960 | Canada | 30/384 |

*Primary Examiner*—Jimmy C. Peters

[57] ABSTRACT

The specification discloses a chain saw having a saw bar which is fastened to the frame of the chain saw so that most of the saw bar is outward of the chain saw frame (referred to as the forward portion), which portion is exposed for effective cutting, but with a lever portion rearward of the frame and the drive sprocket of the chain saw for improved mounting and adjustment. The saw bar forms a part of a cassette which also includes a drive sprocket trapped in the saw bar and a saw chain extending around the sprocket and the forward portion of the saw bar. A cover has clamping bosses clamping the saw bar to the frame, and an adjustment screw engaging the rearward end of the saw bar is mounted on the frame at the rear thereof so that it is readily accessible.

15 Claims, 6 Drawing Figures

FIG.1
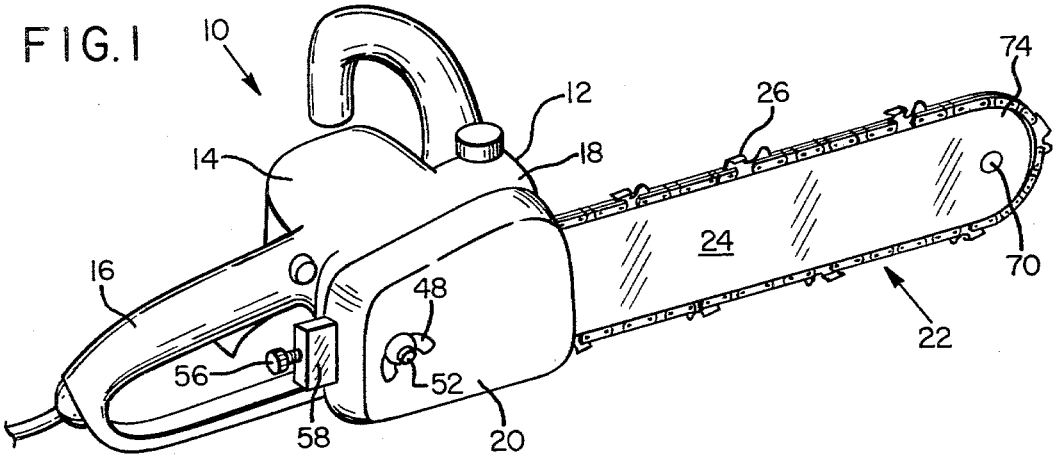
FIG.2
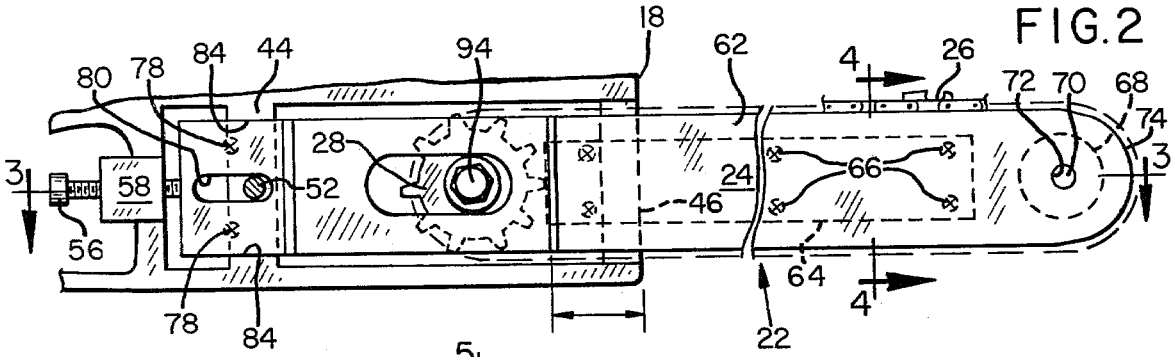
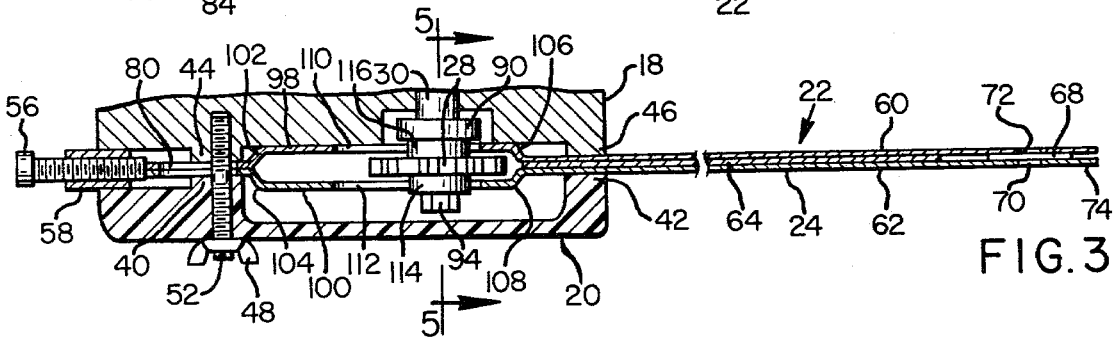
FIG.3
FIG.4
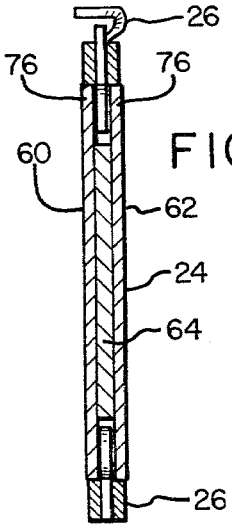
FIG.5
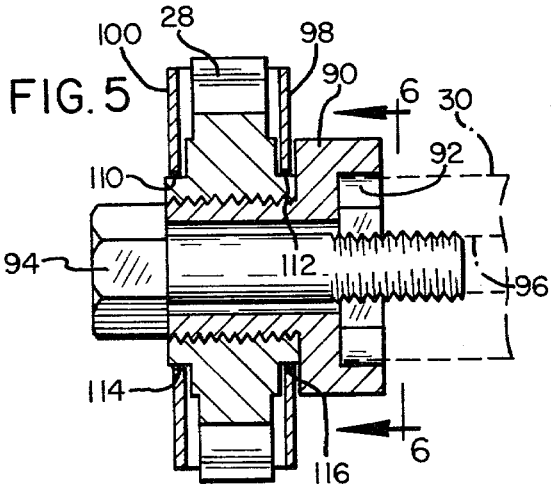
FIG.6
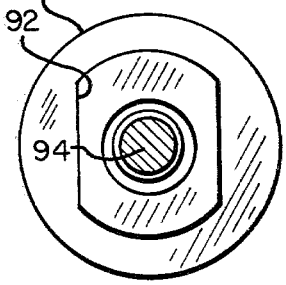

CHAIN SAW

DESCRIPTION

This invention relates to an improved chain saw, and has for an object thereof the provision of a new and improved chain saw.

Another object of the invention is to provide a saw bar adapted to be secured to a chain saw frame rearward of a drive sprocket of the chain saw.

A further object of the invention is to provide a saw chain cassette including a saw bar, a saw chain and a drive sprocket carried by the saw bar.

Another object of the invention is to provide a saw bar having a mounting portion extending over a drive sprocket to a point rearward of the drive sprocket.

Another object of the invention is to provide a saw bar including two plates having first portions secured to a spacer plate to form a forwardly extended saw chain guiding portion and also having sprocket clearance portions extending around a drive sprocket and rearwardly extended mounting portions positioned rearwardly of the drive sprocket.

Another object of the invention is to provide a chain saw including a saw bar extending from a saw chain guiding portion thereof past a drive sprocket and rearward of the drive sprocket where it is clamped against a frame of the chain saw by a boss on a cover to form a cantilever mounting.

Another object of the invention is to provide in a chain saw a saw bar extending forwardly from the chain saw from a position rearward of a drive sprocket.

DRAWINGS

In the drawings:

FIG. 1 is a perspective view of an improved chain saw forming one embodiment of the invention;

FIG. 2 is a fragmentary, vertical, sectional view of the chain saw of FIG. 1;

FIG. 3 is a horizontal, sectional view taken along line 3—3 of FIG. 2;

FIG. 4 is an enlarged, vertical, sectional, view taken along line 4—4 of FIG. 2;

FIG. 5 is an enlarged, vertical, sectional view taken along line 5—5 of FIG. 3; and, FIG. 6 is an enlarged, vertical, sectional view taken along line 6—6 of FIG. 5.

A chain saw 10 forming one embodiment of the invention includes a chain saw housing 12 having a motor housing 14, a handle 16, a head end frame or casting 18 secured by long screws to the motor housing and a cover 20. A cassette 22 has a saw bar 24 guiding a saw chain 26 driven by a drive sprocket 28 mounted on a motor shaft 30. The cassette includes the saw chain and the sprocket, and is attachable to and detachable from the saw as a unit.

The saw bar 24 is clamped to the head end casting 18 both at the front and at the rear of the sprocket by boss portions 40 and 42 of the cover 20 and lands 44 and 46 of the casting 18. A wing nut 48 screwed onto a stud 52 clamps the cover to the casting. An adjustment screw 56 screwed into a nut 58 welded to the casting 18 engages the end of the saw bar 24 and adjusts it to a chain tightening position while the wing nuts are loosened. This adjustment mechanism gives a strong, positive tightening of the saw chain, and is conveniently located at the rear of the chain saw. Also, such adjustment is achieved at a remote point from the saw chain and thus offers the advantage of increased safety.

The saw bar 24 includes outer plates 60 and 62 welded to a center plate 64 by spotwelds 66 and trap a nose sprocket 68 having an axle member 70 projecting through holes 72 in nose portion 74 of the plates 60 and 62. The saw chain is guided by guide edges 76 of the forward or chain guiding portions of plates 60 and 62, outer edge portions of the plates 60 and 62 forming a groove for the chain with the edge of the centerplate. The rearward end portion of the saw bar is formed by the two plates 60 and 62 welded together by spotwelds 78. The saw bar has a longitudinal guide slot 80, which could be off-center to insure that the cassette cannot be reversed. Also, a pair of lands 84 forms a guideway for longitudinal adjustment of the saw, the pair of lands 84 being rearward or to the left of the sprocket, as viewed in FIG. 2.

The sprocket 28 is screwed onto an adapter 90 having a keying sprocket 92 receiving the shaft 30 of an electric motor of the saw. A capscrew 94 screwed into tapped bore 96 of the shaft locks the adapter to the shaft. Intermediate entrapping portions 98 and 100 of the plates 60 and 62 are spaced apart by bent portions 102, 104, 106 and 108 from each other to accommodate the drive sprocket and provide clearance for the portion of the saw chain passing around the sprocket. The portions 98 and 100 have longitudinal slots 110 and 112 in which boss portions 114 and 116 of the sprocket fit.

The saw bar 24 being clamped both rearwardly and forwardly at points spaced apart almost half the length of the saw bar is very securely held. Also, since the saw bar is securely held rearwardly thereof, the casting 18 and cover 20 need and do extend in the forward direction only slightly beyond the sprocket 28 so that a very long portion of the saw bar and saw chain are exposed and effective for sawing.

The saw bar 24, the saw chain 26 and the sprocket 28 are a unit and installed, removed and handled as such. The unit may be easily assembled in the saw and disassembled therefrom.

What is claimed is:

1. In a chain saw, a prime mover including a shaft and frame means, a sprocket keyed to the shaft, a saw bar, releasable means for clamping the saw bar to the frame means in a position in which the saw bar extends forwardly from the sprocket, and adjustment screw means mounted on the frame means at the rear of the sprocket and engaging the saw bar to hold the saw bar against rearward movement.

2. The chain saw of claim 1 wherein the saw bar has a rear mounting portion positioned to the rear of the sprocket and engaged by the adjustment screw means.

3. The chain saw according to claim 2 including means for securing said rear mounting portion of said saw bar to said frame means.

4. A chain saw comprising:

a frame having a motor housing, and a motor shaft extending laterally outwardly therefrom, a drive sprocket for keying to said motor shaft, a substantially unitary saw bar having a rearward mounting portion, a forward saw chain guiding portion and a wider intermediate portion having sides spread apart for adjustably receiving said drive sprocket therebetween, a saw chain entrained on the sprocket through the intermediate portion of said saw bar and on the saw chain guiding portion of the saw bar, and mounting means for securing the rearward portion of said saw bar to said frame for locating said sprocket in alignment with said motor shaft while extending said saw chain guiding portion carrying said chain longitudinally forwardly past said frame from said sprocket, including adjustment screw means mounted on the rear portion of the frame and engaging the rearward portion of the saw bar.

5. A chain saw comprising:

a frame having a motor housing, and a motor shaft extending laterally outwardly therefrom, a drive sprocket for keying to said motor shaft, a substantially unitary saw bar having a rearward mounting portion, a forward saw chain guiding portion and a wider intermediate portion having sides spread apart for adjustably receiving said drive sprocket therebetween, a saw chain entrained on the sprocket through the intermediate portion of said saw bar and on the saw chain guiding portion of the saw bar, and mounting means for securing the rearward portion of said saw bar to said frame for locating said sprocket in alignment with said motor shaft while extending said saw chain guiding portion carrying said chain longitudinally forwardly past said frame from said sprocket, wherein the saw bar, the saw chain and the drive sprocket form a cassette attachable to and detachable from the frame and the motor shaft as a unit.

6. An assembly including a cutting chain, guide bar and drive sprocket, said assembly being mountable and demountable as a cassette unit on a power head, the guide bar, including a rearward mounting portion and a forward saw chain guiding portion having guide slots along the side edges adapted to entrain therein the guide tangs of said chain, and a guide means at a forward end of the guide bar for guiding the chain around said end from one side edge guide slot to the other side edge guide slot, and a wider intermediate portion having sides spread apart for adjustably receiving said drive sprocket therebetween, said guide bar carrying said drive sprocket, the drive sprocket including sprocket teeth and means for interengaging the drive sprocket to the drive shaft of said power head, said sprocket engaging a loop of the chain as entrained in the guide slots and end guide means and through said intermediate portion, said mounting portion extending rearwardly past said intermediate portion, and means for releasably fastening said mounting portion rearwardly of said drive sprocket to said power head for disposing said drive sprocket in position for engaging the drive shaft while disposing said guide bar and chain longitudinally forward of said sprocket substantially past said power head.

7. A guide bar for a cutting chain, said guide bar comprising:

a pair of plates defining forward chain guiding portions and intermediate sprocket entrapping portions, said forward guiding portions being rigidly secured together in positions spaced a predetermined distance apart so as to form a guiding groove therebetween for receiving and guiding a cutting chain, a drive sprocket carried by said intermediate portions, said intermediate portions being spaced apart sufficiently farther than said predetermined distance to receive said drive sprocket therebetween, with at least one of the intermediate portions having a clearance slot for connecting the drive sprocket to a driving shaft, and a cutting chain entrained around said chain guiding portions and over said drive sprocket between said intermediate portions, said guide bar having rearward portions located behind said intermediate portions from said chain guiding portions and constructed for releasable mounting rearwardly of said drive sprocket to a power head for disposing said drive sprocket in engaging relation with a power head driving shaft while disposing said guide bar and chain longitudinally forward of said sprocket substantially past said power head, said guide bar, drive sprocket and chain being mountable and demountable to said power head as a unit.

8. In a chain saw, a frame having a motor housing and a motor shaft, a saw chain and a drive sprocket for driving the same, a saw bar having a pair of plates defining forward saw chain guiding portions, rear mounting portions and intermediate sprocket-entrapping portions, means for securing the forward saw chain guiding portions rigidly together in positions spaced a predetermined distance apart so as to form a guiding groove therebetween for receiving said saw chain, the intermediate portions being spaced apart sufficiently farther than said predetermined distance so as to receive said drive sprocket adjustably therebetween, with at least one of the intermediate portions having a clearance slot for connecting the drive sprocket to said motor shaft, and means for securing said rear mounting portions to the side of the frame of said chain saw for support by said frame.

9. The apparatus according to claim 8 including adjustment screw means mounted on the rear portion of the frame and engaging the rear of the saw bar.

10. The apparatus according to claim 9 wherein said adjustment screw means has a threadable connection with said frame and is accessible rearwardly of said frame, said screw means engaging the rearward end of said saw bar for tensioning said saw bar in a forward direction.

11. An assembly including a cutting chain, guide bar and drive sprocket, said assembly being mountable and demountable as a unit on a power head, said guide bar including a pair of side plate portions comprising forward chain guiding portions spaced a predetermined distance apart so as to form a guiding groove for said cutting chain, said predetermined distance being less than the width of said cutting chain, and intermediate sprocket entrapping portions, said drive sprocket being carried by said intermediate portions, said intermediate portions being spaced apart sufficiently farther than said predetermined distance and farther apart than the width of said cutting chain for adjustably receiving said drive sprocket therebetween, the chain being entrained on the sprocket between said intermediate portions and around said forward guiding portions, the guide bar having a rearward mounting portion located behind said intermediate portions from said guiding portions being constructed for releasable mounting rearwardly of said drive sprocket on said power head for disposing said drive sprocket in engaging relation with the power head driving shaft while disposing said guide bar and chain longitudinally forward of said sprocket substantially past said power head.

12. An assembly including a cutting chain, guide bar and drive sprocket, said assembly being mountable as a unit on a power head, the guide bar having a rearward mounting portion, a forward chain guiding portion and an intermediate portion for receiving the drive sprocket, the chain being entrained on the sprocket and around said forward guiding portion, the guide bar rearward mounting portion located behind said intermediate portion from said guiding portion being constructed for releasable mounting rearwardly of said drive sprocket on said power head for disposing said drive sprocket in engaging relation with the power head driving shaft while disposing said guide bar and chain longitudinally forward of said sprocket substantially past said power head, said rearward portion being provided with a longitudinally elongated slot for receiving a fastener and including a clamping cover for securing said guide bar to said power head by means of said fastener.

13. The apparatus according to claim 12 wherein said clamping cover engages said guide bar both on said rearward mounting portion and on said forward chain guiding portion immediately forward of said drive sprocket.

14. An assembly including a cutting chain, guide bar and drive sprocket, said assembly being mountable as a unit on a power head, the guide bar having a rearward mounting portion, a forward chain guiding portion and an intermediate portion for receiving the drive sprocket, the intermediate portion of the guide bar being provided with longitudinal slots for adjustably receiving boss portions of said sprocket, the chain being entrained on the sprocket and around said forward guiding portion, the guide bar rearward mounting portion located behind said intermediate portion from said guiding portion being constructed for releasable mounting rearwardly of said drive sprocket on said power head for disposing said drive sprocket in engaging relation with the power head driving shaft while disposing said guide bar and chain longitudinally forward of said sprocket substantially past said power head.

15. An assembly including a cutting chain, guide bar and drive sprocket, said assembly being mountable as a unit on a power head, the guide bar having a rearward mounting portion, a forward chain guiding portion and an intermediate portion for receiving the drive sprocket, the chain being entrained on the sprocket and around said forward guiding portion, the guide bar rearward mounting portion located behind said intermediate portion from said guiding portion being constructed for releasable mounting rearwardly of said drive sprocket on said power head for disposing said drive sprocket in engaging relation with the power head driving shaft while disposing said guide bar and chain longitudinally forward of said sprocket substantially past said power head, further including adjustment screw means for mounting on said power head and adjustably engaging the rearward portion of said guide bar for urging said chain forwardly with respect to said sprocket.

* * * * *

UNITED STATES PATENT AND TRADEMARK OFFICE

CERTIFICATE OF CORRECTION

PATENT NO. : 4,316,327

DATED : February 23, 1982

INVENTOR(S) : LEWIS A. SCOTT and DUANE M. GIBSON

It is certified that error appears in the above—identified patent and that said Letters Patent is hereby corrected as shown below:

Col. 2, line 20, "sprocket" should have been --socket--.

Signed and Sealed this

*Fifteenth* Day of *March 1983*

[SEAL]

*Attest:*

GERALD J. MOSSINGHOFF

*Attesting Officer*

*Commissioner of Patents and Trademarks*